United States Patent [19]

Smrt

[11] Patent Number: 4,940,184

[45] Date of Patent: Jul. 10, 1990

[54] SPRAYING APPARATUS WITH SPEED INDICATING ASSEMBLY

[75] Inventor: Thomas J. Smrt, Cary, Ill.

[73] Assignee: Fox Valley Systems, Inc., Cary, Ill.

[21] Appl. No.: 330,456

[22] Filed: Mar. 30, 1989

[51] Int. Cl.[5] ..... B05B 1/28; B05B 9/04; B05B 15/00; E01C 23/16

[52] U.S. Cl. ..... 239/71; 239/150; 239/754; 73/494; 116/62.1; 116/284; 356/23

[58] Field of Search ..... 239/71, 150, 722, 754, 239/288–288.5, 578; 280/47.34; 73/493, 494, 529; 116/200, 284, 62.1; 356/23, 24

[56] References Cited

U.S. PATENT DOCUMENTS

| | | | |
|---|---|---|---|
| 1,671,012 | 5/1928 | Collins | 73/529 |
| 2,418,651 | 4/1947 | Mausshardt | 356/23 |
| 3,796,353 | 3/1974 | Smrt | 239/150 |
| 3,807,634 | 4/1974 | Vogt | 239/150 |

FOREIGN PATENT DOCUMENTS

| | | | |
|---|---|---|---|
| 2150375 | 6/1985 | United Kingdom | 239/71 |

*Primary Examiner*—Douglas C. Butler
*Assistant Examiner*—Karen B. Merritt
*Attorney, Agent, or Firm*—Leydig, Voit & Mayer

[57] ABSTRACT

A movable marking apparatus for marking a supporting surface includes a housing member, wheels rotatably mounted to the housing for engaging the supporting surface and rolling on it, and a handle assembly for controlling the apparatus and actuating the nozzle of a spray can. The apparatus also includes a speed indicating assembly rotatably mounted on the apparatus and connected to a wheel of the apparatus. This assembly has at least one set of indicia disposed in spaced intervals on the assembly. This indicia appears as a solid line when a user moves the apparatus at a predetermined speed.

9 Claims, 1 Drawing Sheet

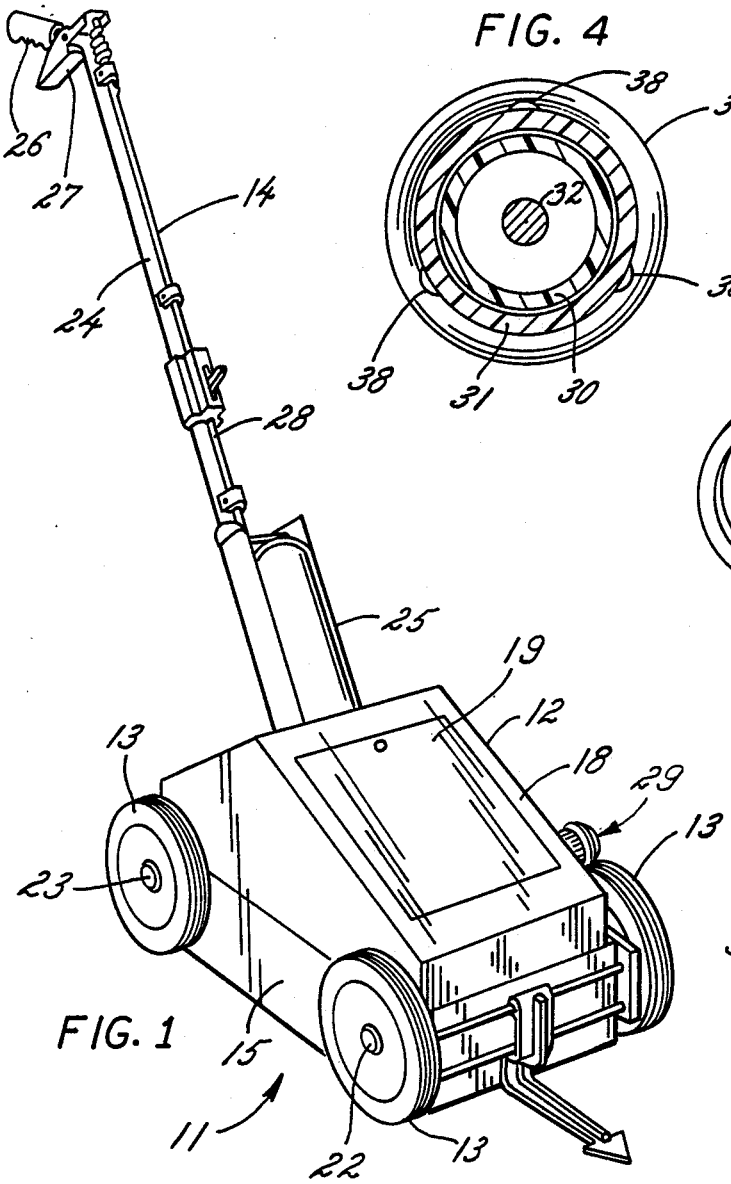
FIG. 1
FIG. 4
FIG. 2
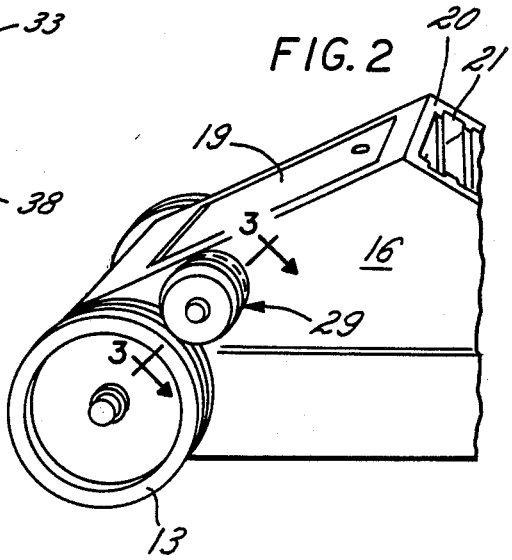
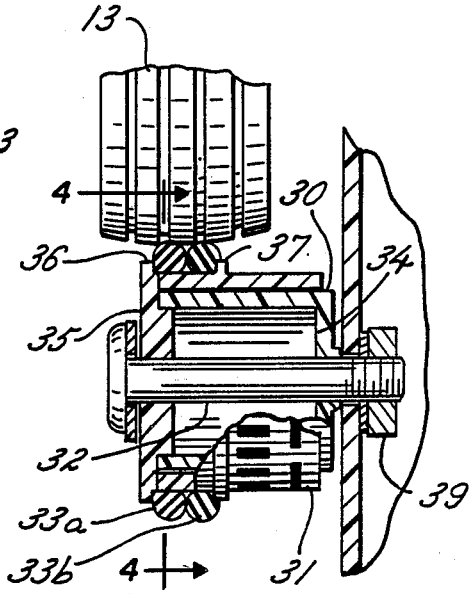
FIG. 3
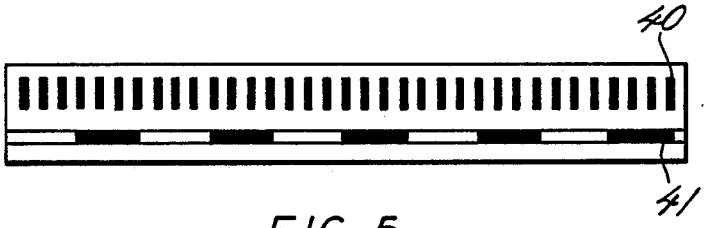
FIG. 5

SPRAYING APPARATUS WITH SPEED INDICATING ASSEMBLY

BACKGROUND OF THE INVENTION

1. Field Of The Invention

The present invention relates generally to a spraying apparatus with a speed indicating assembly, and more particularly to a spraying apparatus which includes a speed indicating assembly and which allows a user to move the apparatus at a predetermined speed and mark a surface.

2. Description Of The Prior Art

The prior art includes a wide variety of spraying apparatus which mark the surface upon which a user moves them. These apparatus generally include a housing, wheels rotatably mounted to the housing, and a handle assembly with which a user controls the apparatus and activates an aerosol spray can. In operating these devices, a user moves them over a supporting surface while actuating the aerosol spray can to apply paint to the surface.

When marking a surface, the user must move the spraying apparatus at a first speed at which the apparatus applies a continuous layer of paint. If the user moves the apparatus faster than this speed, the mark has discontinuities or thin spots which the user typically corrects by returning and applying a second coat. This procedure increases the time and expense of operating the spraying apparatus. If a user moves the apparatus slower than this optimum speed, the machine applies more paint than necessary, wasting paint and increasing the cost of operation. Finally, when the user uses the machine to touch up markings which have worn away, he or she must move the apparatus at a second, faster speed to avoid using more paint than required.

Therefore, a spraying apparatus should include means for indicating a first predetermined speed at which the apparatus may first mark a surface, and a second, faster speed at which it may touch up existing markings. Moreover, any speed indicator used must have a simple construction which minimizes the expense of manufacture and assembly. The prior apparatus currently used do not have such a speed indicator. For most of these prior devices an operator must use a trial and error procedure to determine an optimum speed. He or she must maintain that speed or repeat the trial and error procedure.

The apparatus of the present invention avoids the disadvantages of the prior art. It includes a speed indicating assembly which indicates one or more predetermined speeds, one at which the user applies fresh markings to a surface and a second, faster speed at which the apparatus touches up existing markings. This indicator minimizes the expense of manufacture and assembly and gives precise, uniform and reliable performance. It comprises a small number of components which produce the requisite mechanical action to indicate one or more predetermined speeds.

SUMMARY OF THE INVENTION

In accordance with one embodiment of the present invention, a spraying apparatus includes a housing which functions as a windscreen and a support. Wheels rotatably mounted on the housing engage a supporting surface and roll on it to allow easy movement of the housing over the surface. A handle assembly secured to the housing allows a user to control the apparatus and activate an aerosol spray can disposed on the apparatus. The aerosol spray can includes a nozzle which discharges paint onto the subtending surface.

The apparatus also includes a speed indicating assembly which allows a user to move the apparatus at one or more predetermined speeds. This assembly has a rotating member rotatably mounted on the apparatus and connected to a wheel. The rotating member lies where an operator may easily see it; and the wheel connected to it drives it as the operator pushes or pulls the apparatus along a supporting surface.

The speed indicating assembly also includes a pair of O-rings made of rubber or any suitable, resilient material. The O-rings lie disposed around the rotating member, between the rotating member and the wheel which drives the rotating member, in a seat defined by the rotating member. The diameter of the O-rings is greater than the distance between the wheel and the rotating member; thus, the O-rings lie squeezed between the two in pressure contact with them. Alternatively, the speed indicating assembly may have only one O-ring.

The speed indicating assembly further includes a first set of indicia disposed in spaced intervals around the rotating member. At a first predetermined speed, this indicia appears as a solid line. A second set of indicia lies disposed around the rotating member in spaced intervals. The spacing of the second set of indicia differs from the spacing of the first set and, therefore, the second set of indicia appears as a solid line at a second predetermined speed.

In operation, a user moves the spraying apparatus by pushing or pulling it while activating the aerosol spray can. As the wheels roll over the supporting surface, the wheel in contact with the speed indicator assembly drives the speed indicator assembly. At a first predetermined speed (a speed at which the aerosol spray can applies the proper amount of paint to make fresh markings on a surface), the first set of indicia appears as a solid line. The user moves the apparatus at this speed to mark the supporting surface with the aerosol spray can. When touching up existing markings, the user moves the apparatus at a speed at which the second set of indicia appears as a solid line—the speed at which the spray can applies the proper amount of paint to touch up an existing mark.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a perspective view of a preferred embodiment of a spraying apparatus embodying the present invention.

FIG. 2 is an enlarged, partial perspective view of the apparatus of the present invention.

FIG. 3 is a sectional view taken along line 3—3 in FIG. 2.

FIG. 4 is a sectional view taken along line 4—4 in FIG. 3.

FIG. 5 is a developed view of the indicia-bearing portion of the speed indicating assembly used in the spraying apparatus of the present invention.

While the following text describes the invention in connection with a preferred embodiment, one should understand that the invention is not limited to this embodiment. Furthermore, one should understand that the drawings are not necessarily to scale. In certain instances, the applicant may have omitted details which are not necessary for an understanding of the present invention.

DETAILED DESCRIPTION OF THE DRAWINGS AND AN EMBODIMENT

Turning now to the drawings, FIG. 1 shows the spraying apparatus and speed indicating assembly of the present invention at 11. This apparatus generally includes a housing 12, four wheels 13 rotatably mounted on the housing 12, and a handle assembly 14. The housing 12 is a box-like structure with an open bottom through which the apparatus discharges material, e.g., paint, onto a surface. It has sidewalls 15 and 16 and an inclined top segment 17 with a front portion 18 which defines an opening and a door 19 for closing the opening and a rear portion 20 which defines an opening 21 through which the handle assembly 14 extends into the housing. The housing 12 is made from molded plastic or any other material of high strength and rigidity, e.g., sheet metal; and it functions as a support and a wind screen. (U.S. Pat. No. 4,641,780 issued to Thomas Smrt on Feb. 10, 1987 describes the housing 12 in greater detail; and the applicant incorporates its disclosure to the present description by this reference.)

The wheels 13 lie rotatably mounted to the housing 12, two on opposite ends of a front axle 22 and two on opposite ends of a rear axle 23. Each axle, 22 and 23, extends across the housing 12 through suitably sized openings formed in it. The wheels 13 engage the subtending supporting surface and allow the user to push the apparatus over the surface. Each wheel 13 includes a round inner portion made of metal or any other rigid material and an outer portion made of rubber or any other resilient material.

The handle assembly 14 lies at a shallow angle to the vertical. It includes a rod member 24 releasably secured at one end to the housing 12. This rod member 24 supports a holder 25 for a container C, e.g., an aerosol spray can. It also supports a handle grip 26 and trigger 27 disposed at the end opposite the one secured to the housing 12. The can holder 25 includes an opening at one end through which the nozzle of the spray can extends. A user may actuate the nozzle using a linkage assembly 28 and the trigger 27 and apply a layer of paint or other material contained in the can to the supporting surface below the nozzle. (U.S. Pat. No. 4,262,821 issued to Thomas Smrt on Apr. 21, 1981 describes the handle assembly 14 in greater detail; and the applicant incorporates its disclosure to the present description by this reference.)

Referring now to FIGS. 2–4, the spraying apparatus also includes a speed indicating assembly 29 rotatably mounted to the sidewall 16 proximate the front wheel 13. Alternatively, the location of the assembly may be the area proximate any of the four wheels where a user of the apparatus may easily observe it. This assembly 29 includes an inner sleeve 30; an outer sleeve 31; a bolt assembly 32 for mounting the sleeves 30 and 31 to the housing 12; and a pair of O-rings 33*a* and 33*b* for connecting the assembly 29 to the wheel 13. The inner sleeve 30 is made of a hard plastic material or any other material of high strength and rigidity. It has an integral end segment 34 which closes one of its ends, the inner end proximate the housing 12. This end segment 34 includes an opening at its center through which the bolt 32 extends.

The outer sleeve 31 lies around the inner sleeve 30 in siding engagement with it. It, too is a hard plastic, and it includes a round cap 35 fixedly secured with adhesive or other securing means to the outer end of the inner sleeve 30. This cap 35 is a hard plastic like the sleeves 30 and 31 and includes an opening at its center through which the bolt 32 extends. Its diameter is greater than the outer diameter of the sleeve 31; thus, its distal outer end 36 extends beyond the outer surface of the sleeve 31 and, along with a protuberance 37 which also extends beyond the outer surface of the sleeve 31, defines a U-shaped seat for the O-rings 33*a* and 33*b*. A set of other protuberances 38 of the outer sleeve 31 lie in the seat to prevent the O-rings from sliding relative to the sleeve 31.

The O-rings 33*a* and 33*b* are made of rubber or any other resilient material. They have a diameter of equal magnitude which is greater than the distance between the sleeve 31 and the wheel 13; thus, the O-rings lie squeezed between the sleeve 31 and the wheel 13, in pressure contact with them. Alternatively, the speed indicating assembly 29 may have only one O-ring. As the wheel 13 turns, it drives the O-rings 33*a* and 33*b* and, accordingly, the sleeve 31. The sleeve 31 rotates around the bolt 32 and the inner sleeve 30. If for any reason the sleeve 31 cannot slide relative to the sleeve 30, both of the sleeves may rotate about the bolt 32 which a nut 39 holds in place.

A first set of indicia 40 (e.g., a series of parallel bars) placed on the outer surface of the sleeve 31 at constantly spaced intervals (See FIG. 5) indicates a first speed by appearing as a solid line when a user moves the apparatus at a first predetermined speed. A second set of indicia 41 (e.g., also a series of parallel bars) spaced a constant distance apart similarly indicates a predetermined speed. The spacing of the second set of indicia is greater than the first set; thus, the speed which the second set of indicia indicates is greater than the first speed.

The indicia are strips of paint stenciled onto the surface of the sleeve 31. Alternatively, the indicia may be plastic strips adhered to the sleeve 31 and having a color different from that of the sleeve 31. Although the illustrated embodiment shows two speed indicating sets of indicia, the apparatus may include only one set of indicia, or it may include more than two sets.

Thus, the applicant has provided a spraying apparatus with a speed indicating assembly which allows the user to efficiently operate the machine. While the applicant has shown only one embodiment of the invention, one will understand, of course, that the invention is not limited to this embodiment since those skilled in the art to which the invention pertains may make modifications or other embodiments of the principles of this invention, particularly upon considering the foregoing teachings. For example, one skilled in the art may secure the speed indicating assembly directly to the side of one of the wheels 13. Therefore, by the appended claims, the applicant intends to cover any such modifications or other embodiments as incorporate those features which constitute the essential features of this invention.

What is claimed is:

1. A movable marking apparatus for marking a supporting surface comprising: a housing member; wheel means rotatably mounted to said housing member for engaging the supporting surface and rolling on the supporting surface; handle means secured to said housing for controlling said housing and pushing or pulling the housing along the supporting surface; rotating means rotatably mounted to said apparatus for indicating the speed of the apparatus, said rotating means having an outer surface and being driven by said wheel means, said rotating means including a first set of indicia disposed in spaced intervals on the outer surface, said first set of indicia appearing to be a solid line at a first, predetermined speed.

2. The movable marking apparatus of claim 1, wherein said rotating means includes a second set of indicia disposed in spaced intervals on the outer surface, said second set of indicia appearing to be a solid line at a second, predetermined speed.

3. The movable marking apparatus of claim 1, wherein said rotating means includes resilient means for engaging the wheel means.

4. An improved movable marking apparatus for marking a supporting surface, said apparatus having a housing member; wheel means rotatably mounted to said housing member for engaging the supporting surface and rolling on the supporting surface, said improvement comprising: rotating means rotatably mounted to said apparatus for indicating the speed of the apparatus, said rotating means having an outer surface and being driven by said wheel means, said rotating means including a first set of indicia disposed in spaced intervals on the outer surface, said first set of indicia appearing to be a solid line at a first, predetermined speed.

5. The movable marking apparatus of claim 4, wherein said rotating means includes a second set of indicia disposed in spaced intervals on the outer surface, said second set of indicia appearing to be a solid line at a second, predetermined speed.

6. The movable marking apparatus of claim 4, wherein said rotating means includes resilient means for engaging the wheel means.

7. A speed indicating assembly for a movable marking apparatus which marks a supporting surface and includes a housing and wheel means for moving the housing, said assembly comprising: rotating means rotatably mounted to said apparatus for indicating the speed of the apparatus, said rotating means having an outer surface and being driven by said wheel means, said rotating means including a first set of indicia disposed in spaced intervals on the outer surface, said first set of indicia appearing to be a solid line at a first, predetermined speed.

8. The movable marking apparatus of claim 7, wherein said rotating means includes a second set of indicia disposed in spaced intervals on the outer surface, said second set of indicia appearing to be a solid line at a second, predetermined speed.

9. The movable marking apparatus of claim 7, wherein said rotating means includes resilient means for engaging the wheel means.

* * * * *

UNITED STATES PATENT AND TRADEMARK OFFICE

CERTIFICATE OF CORRECTION

PATENT NO. : 4,940,184

DATED : July 10, 1990

INVENTOR(S) : THOMAS J. SMRT

It is certified that error appears in the above-identified patent and that said Letters Patent is hereby corrected as shown below:

Col. 3, line 17, "17 with a front portion" should be deleted.

Signed and Sealed this

Eighteenth Day of May, 1993

*Attest:*

Michael K. Kirk

MICHAEL K. KIRK

*Attesting Officer*

*Acting Commissioner of Patents and Trademarks*